US010939736B2

(12) United States Patent
Perou

(10) Patent No.: US 10,939,736 B2
(45) Date of Patent: Mar. 9, 2021

(54) MATERNITY BAG WITH INTEGRATED CHANGING MAT AND METHOD THEREOF

(71) Applicant: Krystel Perou, Brossard (CA)

(72) Inventor: Krystel Perou, Brossard (CA)

(73) Assignee: Krystel Perou, Brassard (CA)

( * ) Notice: Subject to any disclaimer, the term of this patent is extended or adjusted under 35 U.S.C. 154(b) by 0 days.

(21) Appl. No.: 15/896,785

(22) Filed: Feb. 14, 2018

(65) Prior Publication Data

US 2019/0246755 A1 Aug. 15, 2019

(51) Int. Cl.
*A45C 9/00* (2006.01)
*A45C 1/02* (2006.01)
*A47D 5/00* (2006.01)

(52) U.S. Cl.
CPC ..... *A45C 9/00* (2013.01); *A45C 1/02* (2013.01); *A47D 5/006* (2013.01)

(58) Field of Classification Search
CPC ..... A45C 9/00; A45C 1/02; A45C 5/006
See application file for complete search history.

(56) References Cited

U.S. PATENT DOCUMENTS 954,840 A * 4/1910 Wiedennan ..... A45F 5/1046 190/102
2,627,885 A * 2/1953 Cassell ..... A45C 3/06 150/105
3,182,701 A * 5/1965 Ginsburg ..... A45C 13/08 150/105
4,068,786 A * 1/1978 Taniguchi ..... A45C 9/00 150/108
4,792,024 A * 12/1988 Morton ..... A45C 9/00 190/1
7,628,187 B2 * 12/2009 Mittelstaedt ..... A45C 3/08 150/105
9,198,489 B2 * 12/2015 Romero ..... A45C 3/08
2008/0185082 A1 * 8/2008 Mejia ..... A45C 3/08 150/105

* cited by examiner

*Primary Examiner* — Tri M Mai
(74) *Attorney, Agent, or Firm* — Damien Calvet; Gowling WLG (Canada) LLP

(57) ABSTRACT

A maternity bag with a bag body defining an outer surface and a changing mat configured to be detachable from the outer surface of the body. The changing mat is optionally made of a same material as the bag body and/or has the same texture or color as the outer surface of the bag body, and is dimensioned to at least partially wrap around the outer surface of the bag body so as to be fully integrated and indistinguishable. The function and the look of the changing mat is concealed as it is integrated to the bag when attached. A method for changing babies using the bag is also provided. The changing mat being wrapped around the bag, it reinforces the body's structure and liberates space inside the bag. The invention provides an elegant and stylishly fashionable look to the bag. The invention also concerns the changing mat configured to be affixed to a diaper bag.

9 Claims, 10 Drawing Sheets

MATERNITY BAG WITH INTEGRATED CHANGING MAT AND METHOD THEREOF

FIELD OF THE INVENTION

The present invention generally relates to baby accessories and, in particular to maternity bags, also known as diaper bags or nappy bags, and methods of using them. The invention also relates to a changing mat for maternity bag.

BACKGROUND OF THE INVENTION

Typical baby changing mat or pad, provided or not within a maternity bag, is generally loosely kept inside the bag.

When the changing mat is attached to the bag, it is generally folded or rolled, and inserted into the bag or attached to the outer wall of the bag by using, for instance a string or a strap. This configuration makes the changing mat visible and a separate item to the bag itself. It thus becomes clear to others that the bag is a diaper bag.

Parents generally use such a traditional bag with a detachable or foldable changing mat or pad when they travel with a baby and generally would not use the bag in any other circumstances.

There is thus a need for a new kind of diaper or maternity bag which by its configuration, does not look like a diaper or maternity bag while still being a useful bag for changing babies.

SUMMARY OF THE INVENTION

The invention is directed to a maternity bag, also named diaper or nappy bag, having a changing mat designed to be an intricate part of the bag's design concealing therefore its function and traditional look.

The shortcomings of the prior art are generally mitigated by a maternity bag having an integrated, preferably indistinguishable, changing mat as disclosed herein.

It is disclosed a maternity bag comprising a bag body defining an outer surface of the bag body; and a changing mat configured to be non-permanently attached to the outer surface of the bag body so as to be an integrated part of the maternity bag.

It is also disclosed maternity bag comprising:

a bag body defining an outer surface of the bag body; and a changing mat configured to be non-permanently attached to the outer surface of the bag body so as to be an integrated part of the maternity bag, the changing mat being further configured in size for a baby to be laid on the changing mat when the changing mat is used for changing the baby.

According to a preferred embodiment, the bag body defines a bottom wall from which extend two side walls, a front wall and a rear wall, and also a top section defining a aperture giving access to inside the bag body, the front and/or rear walls comprising at least one fastener for attaching the changing mat to the outside surface of the body.

According to a preferred embodiment, the changing mat is dimensioned to at least partially or entirely wrap the bottom, front and rear walls of the bag body, and optionally the top section, so as to be indistinguishable, concealed in a design and/or structure of the bag.

According to a preferred embodiment, the changing mat and the bag body are made of identical material.

According to a preferred embodiment, the changing mat and the bag body are made of different material, preferably for styling diversity.

According to a preferred embodiment, the changing mat has a same texture and/or color as the outer surface of the bag body.

According to a preferred embodiment, the changing mat has a different texture and/or color as the outer surface of the bag body, preferably for styling diversity.

According to a preferred embodiment, the changing mat is non-permanently attached to one side of the bag body.

According to a preferred embodiment, the changing mat is non-permanently attached to both side of the bag body.

According to a preferred embodiment, the changing mat may comprise a first mat portion and a second mat portion each hingely connected to a middle mat portion positioned there between, the middle mat portion matching in size the bottom wall of the bag body when the changing mat is attached to the bag body, the first mat portion and the second mat portion each comprising at least one attachment system to attach the first mat portion and the second mat portion to the front and rear walls of the body bag respectively.

According to a preferred embodiment, the changing mat may further comprise a pair of wings hingely connected to the middle mat portion and extending from the middle mat portion in a perpendicular direction respectively to a direction of the first and second mat portion, whereby, in use:

the wings in an unfolded position provide an extra width to the changing mat when the changing mat is used for pampering a baby, or the wings in a folded position over the middle mat portion when the changing mat is attached to the bag body protect the middle mat portion from the bottom wall of the bag body.

According to a preferred embodiment, the changing mat may comprise a protective lining.

According to a preferred embodiment, the lining may be washable.

It is also disclosed a method for changing a baby or toddler using the maternity bag as defined in herein, the method comprising the steps of:

a. detaching and unwrapping the changing mat from the bag body;
b. using the changing mat for changing a baby once the baby is laid on the changing mat; and
c. once the baby has been changed, wrapping back and attaching the indistinguishable changing mat around the bag body.

According to a preferred embodiment, the method further comprises partially or entirely wrapping the changing mat over the outer surface of the bag body so as to be indistinguishable, concealed and/or unrecognizable.

The invention is also directed to a changing mat for maternity bag. The maternity bag comprises a bag body defining a bottom wall from which extend two side walls, a front wall and a rear wall, and also a top section defining a aperture giving access to inside the bag body, the front and/or rear walls comprising at least one fastener for non-permanently attaching the changing mat to the outside surface of the body. The changing mat comprises a first mat portion and a second mat portion each hingely connected to a middle mat portion positioned there between, the middle mat portion matching in size the bottom wall of the bag body when the changing mat is attached to the bag body. The first mat portion and the second mat portion each comprises at least one attachment system to attach the first mat portion and the second mat portion to the front and rear walls of the body bag respectively in collaboration with the at least one fastener.

According to a preferred embodiment, the changing mat may further comprise a pair of wings hingely connected to the middle mat portion and extending from the middle mat portion in a perpendicular direction respectively to a direction of the first and second mat portion, whereby, in use:

the wings in an unfolded position provide an extra width to the changing mat when the changing mat is used for pampering a baby, or the wings in a folded position over the middle mat portion when the changing mat is attached to the bag body protect the middle mat portion from the bottom wall of the bag body.

According to a preferred embodiment, the wings further extend from the first and second mat portions in a foldable configuration to extend the extra width of the mat.

According to a preferred embodiment, the changing mat may comprise a protective lining, preferably washable.

Advantageously, the maternity bag does not look like a traditional diaper or maternity bag its design and concept.

Also, the changing mat being wrapped around the bag, the changing mat may reinforce the bottom, front and rear walls of the bag that can therefore be loaded with all the items useful for pampering a baby. Also, the external location of the changing mat allows liberating more space in the interior of the bag body.

By being detachably attached on the outer surface of the bag body, the changing mat or pad provides easier access to the interior of the bag body via the aperture, and also for easier access to the pad itself when needed.

The present invention provides an elegant and stylishly fashionable look to the bag.

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which.

DETAILED DESCRIPTION OF THE PREFERRED EMBODIMENT

A novel maternity or diaper bag will be described hereinafter. Although the invention is described in terms of specific illustrative embodiments, it is to be understood that the embodiments described herein are by way of example only and that the scope of the invention is not intended to be limited thereby.

Figure 1:
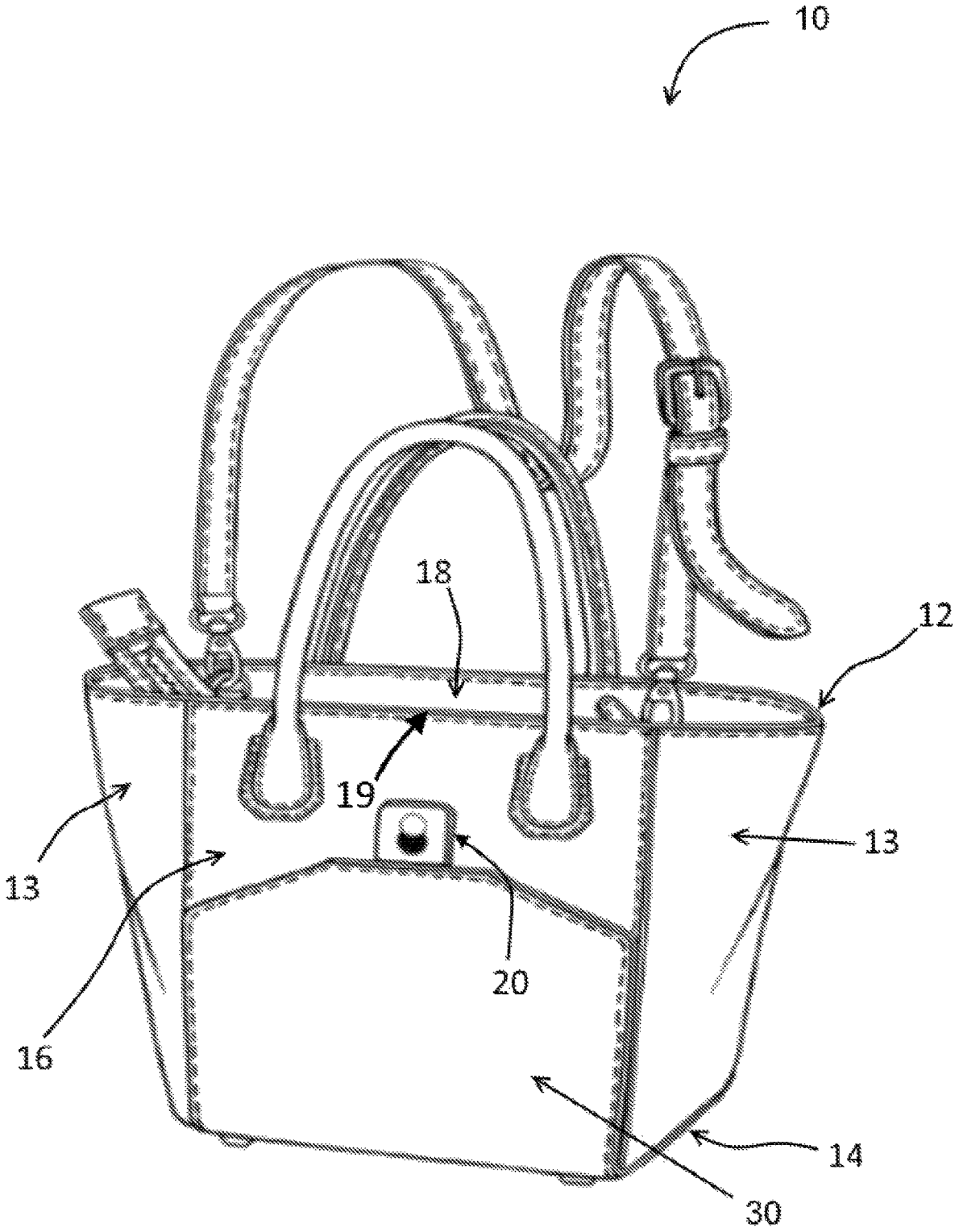
FIG. 1 is an illustration of the front view the maternity bag with the changing mat fully attached to a bag body, in accordance with one embodiment.
Figure 2:
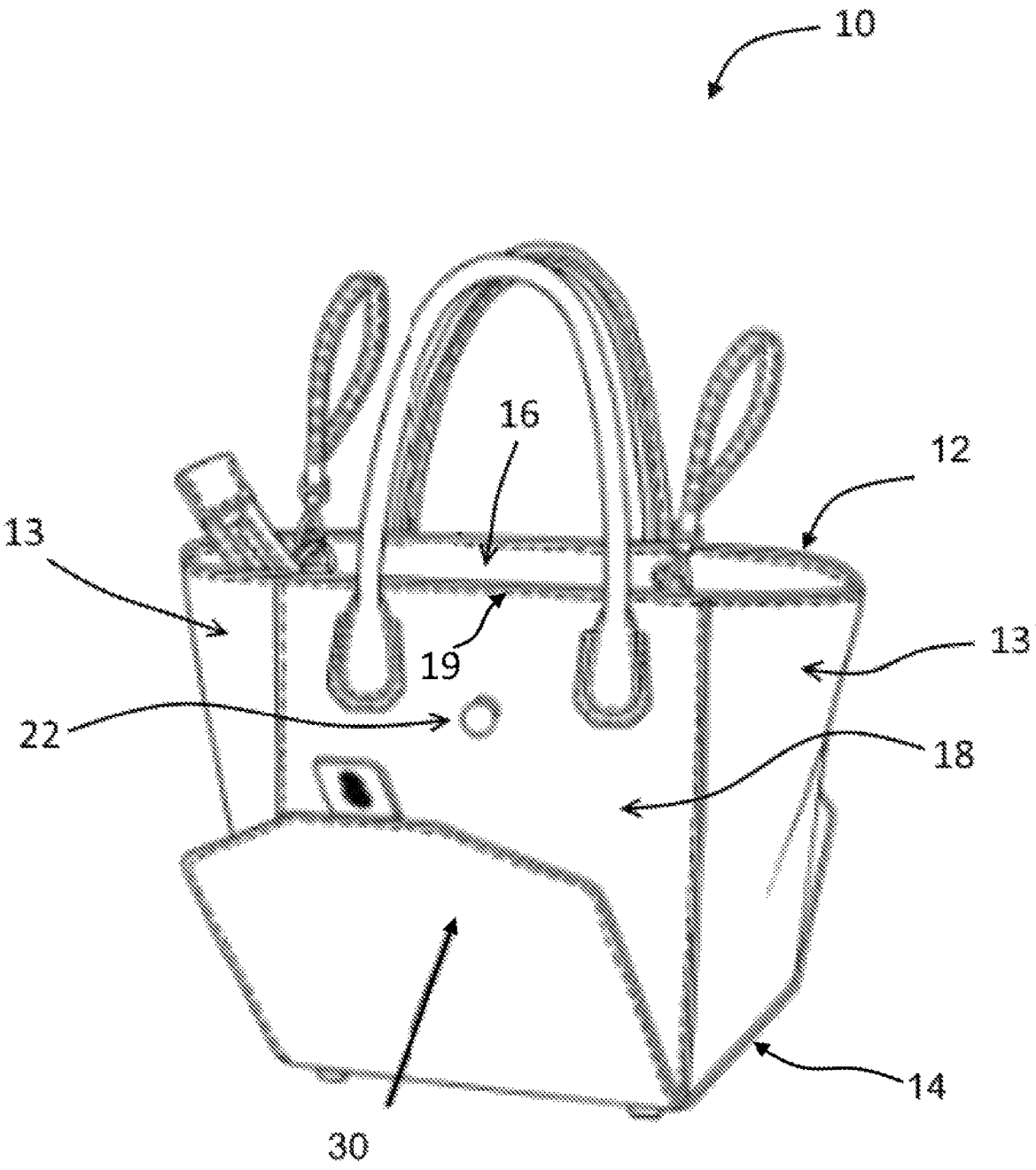
FIG. 2 is an illustration of the rear view the maternity bag with the changing mat being partially detached.

Referring now to FIGS. 1 and 2, shown therein is a first example of a maternity bag for changing babies. The bag 10, in accordance with this first embodiment, comprises a bag body 12 and a changing mat 30. As better shown on FIG. 2, the changing mat 30 is attachable to the bag body 12.

The bag 10 may be used, for example, for containing inside the bag items necessary for changing a baby or a toddler and also carrying the indistinguishable changing mat 30 wrapped around the bag body 12. When the user of the bag 10 needs to change a baby, the user may simply detach the changing mat 30 from the outside surface of the bag body 12.

Referring to FIG. 1 or 2, the bag body 12 may have a bottom wall 14, two side walls 13, a front wall 16 and a rear wall 18 extending from the bottom wall 14. Preferably, the front and rear side walls 16, 18 are identical, but not necessarily. The bag also has a top section 19 comprising an aperture for easy access to inside the bag.

Each of the front and rear side walls 16, 18 may have at least one fastener 20, 22 for attaching the changing mat 30 to the outside surface of the body 12.

Figure 3:
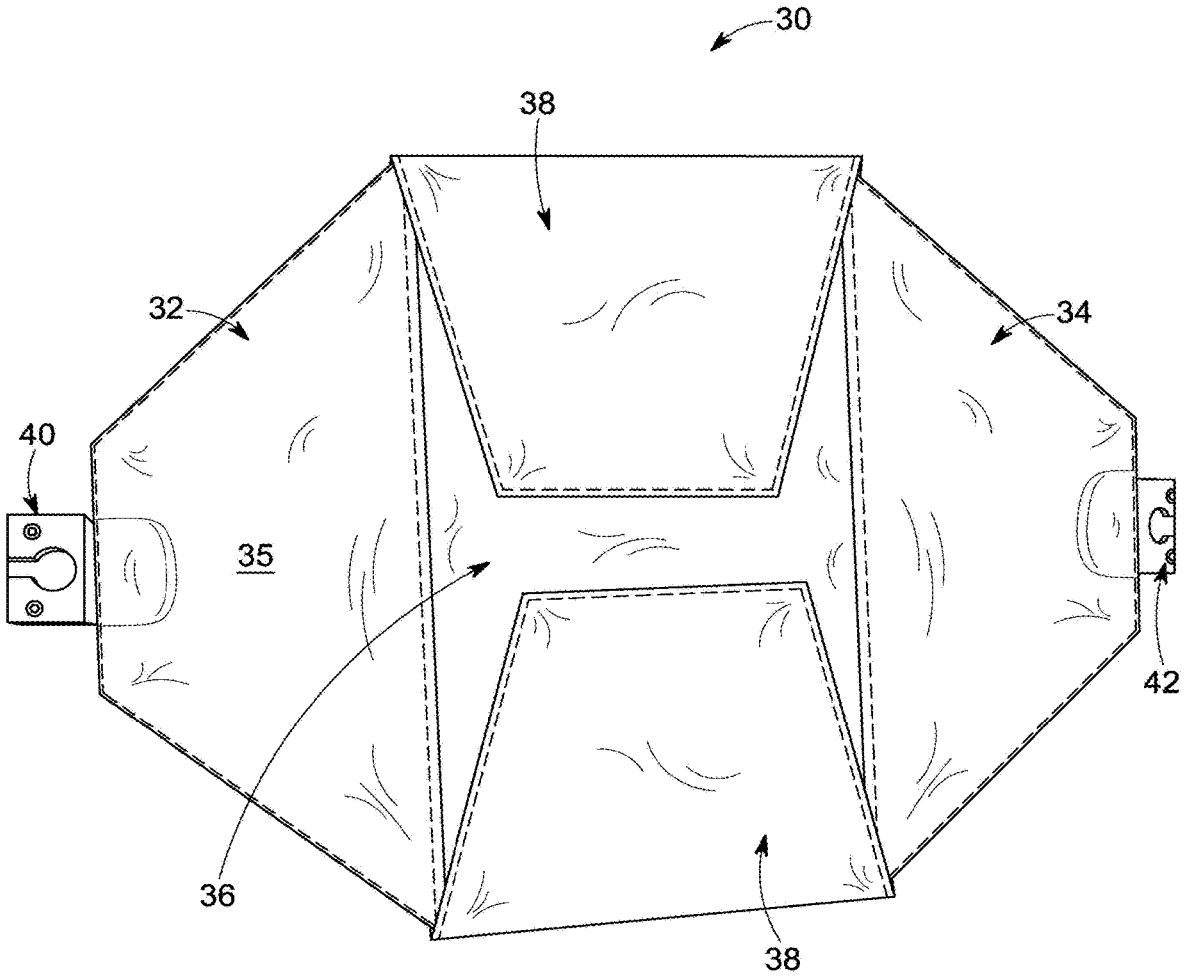
FIG. 3 is a picture showing an exemplary changing mat detached from the bag, in accordance with one embodiment.

Referring now to FIG. 3, the changing mat 30 has a first mat portion 32 and a second mat portion 34 extending from a middle mat portion 36 positioned there between. The mat portion 36 may have folded wings 38, providing extra width to the mat if needed and more hygiene for baby care, and thus protecting the middle part portion 36 where the baby or toddler is laid and separating/protecting it from the bottom wall of the bag body, here again for hygiene purpose. The inside surface of the changing mat in contact with the baby may also comprise a protective lining 35 made of known polymeric material or the like. The lining may or may not be detachable from the pad wall 30 and washable in which case could be washable or simply wiped clean.

Each of the first and the second mat portions 32, 34 is attachable to one of the bag body's front and rear walls 16, 18 using fixing means 40, 42 configured to connect with the fasteners 20, 22 respectively. In one embodiment, the first mat portion 32 may be attachable to (and detachable from) the front wall 16 of the bag body 12 and the second mat portion 34 may be attachable to the rear wall 18 of the bag body 12.

In another embodiment described herein after, both the first mat portion 32 and the second mat portion 34 may be attachable to (and detachable from) the same front wall 16 or rear wall 18.

In the preferred embodiment, the changing mat 30 is dimensioned and configured to at least partially surround, envelop or wrap the bag body 12. The changing mat 30 once wrapped and attached to the bag body 12 becomes indistinguishable as an integrated part of the bag's look, therefore it completes the design of the bag 10.

To be indistinguishable, one or both of the surfaces of the changing mat 30 may (or may not) be made of the same material as the bag body 12. For example, the material of the bag body 12 and one or two of the surfaces of the changing mat 30 may be made of polyester, canvas, fabric, leather, fur, skins, exotic skins, cotton, etc. For example, the color and/or the texture of the surfaces of the changing mat 30 and the bag body 12 may or may not be the same.

Having or not the same material, texture, color and/or other design features of the changing mat 30 and the bag body 12, the mat is designed to harmonize with the overall look of the bag in its whole, helping thus to conceal the fact that the changing mat is a separate piece in its own. Therefore the concept of how the two pieces come together as one helps to provide and project an elegant and stylishly fashionable look to the bag that is completely different and untraditional 10. For example, it may be hard to recognise that the bag 10 has a changing mat 30 outside of the bag body 12 when the changing mat 30 is attached to the bag body 12. The changing mat 30 may look as a decorative element of the bag 10 and not as a functional mat for changing the baby (changing baby's diapers).

Referring again to FIGS. 1, 2 and 3, the first mat portion 32 may have a first mat fastener 40. The second mat portion 34 may have a second mat fastener 42. The first mat 10 fastener 40 is attachable to the front wall fastener 20 and the second mat fastener 42 attachable to the rear wall fastener 22.

The fasteners can be apparent or not depending on the design in which the mat is attended to be attached to the body of the bag. The fasteners can also be magnets hidden inside the material forming the mat of the bag. Alternatively, the fasteners 20, 22 and 40, 42 may be button-type fasteners (as shown in FIG. 1), turning locks or lever locks.

Figure 7:
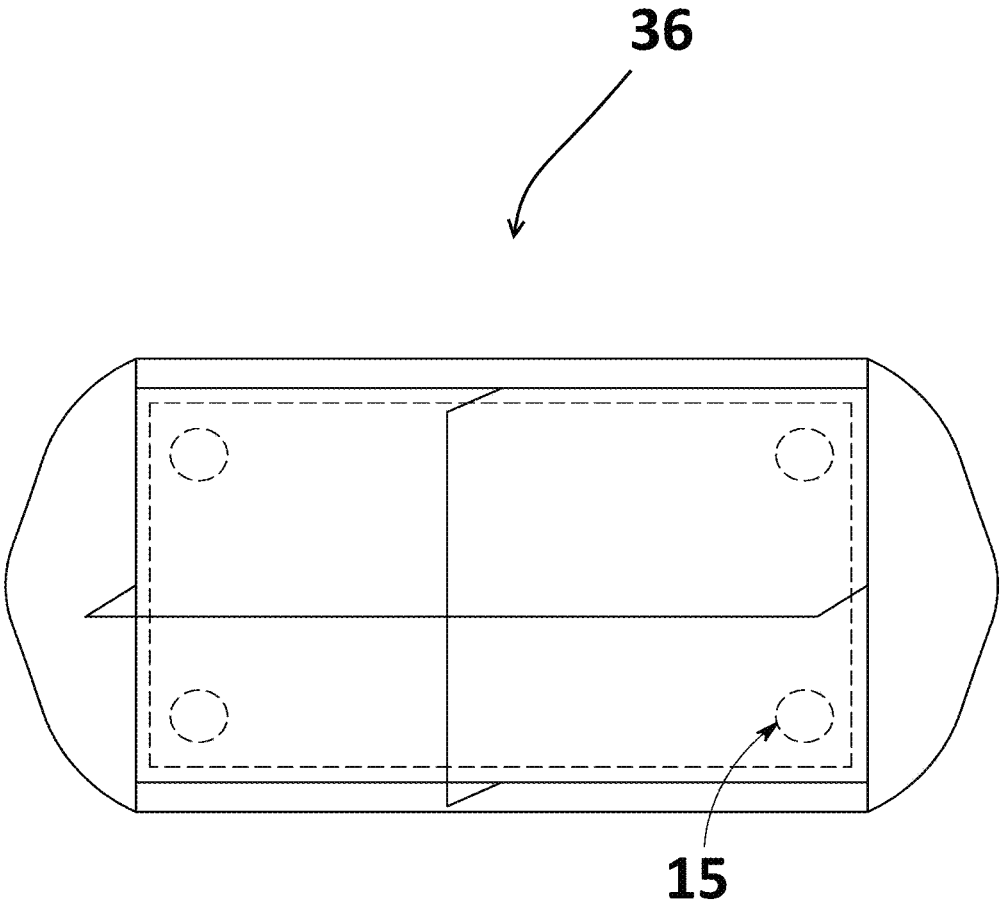
FIG. 7 shows a bag base having invisible mag snaps in accordance with a preferred embodiment.
Figure 8A:
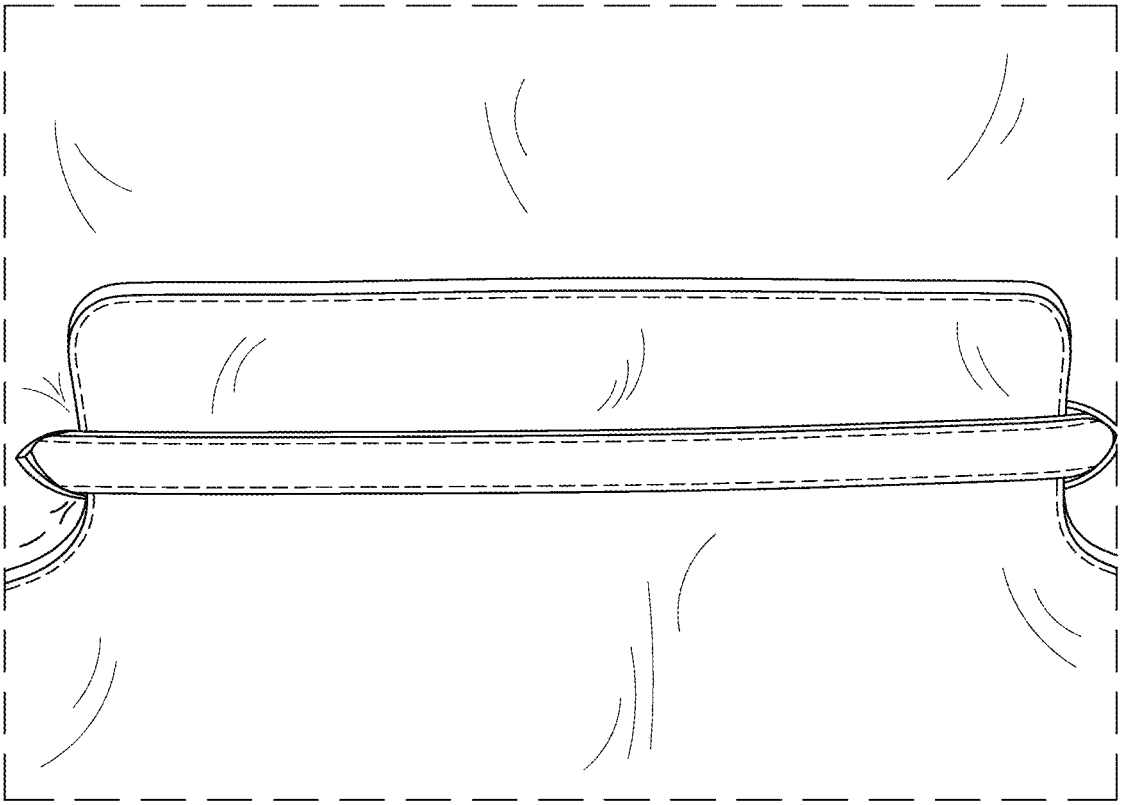
FIG. 8 shows different hidden fasteners for the changing mat: (A) with a reverse; (B) hidden button.
Figure 8B:
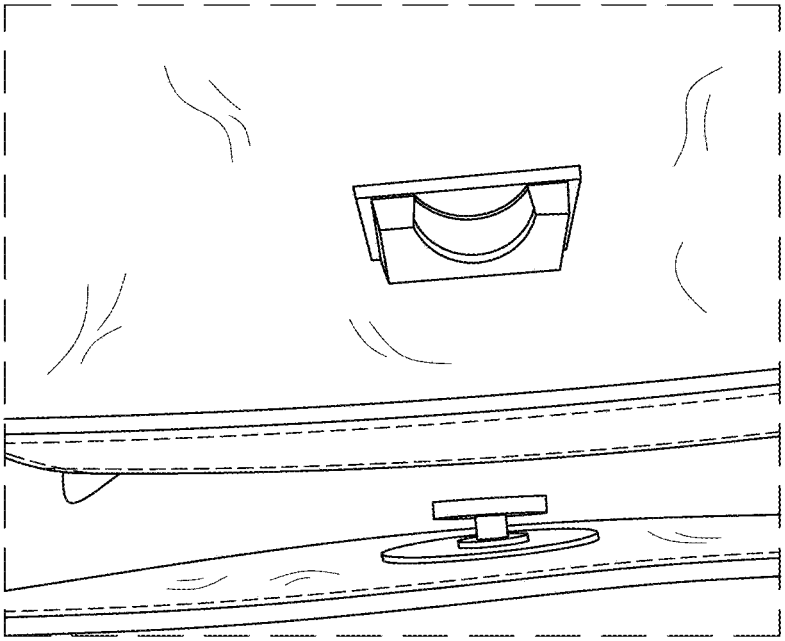

Various examples of the fasteners (A) to (E) are shown at FIG. 6 and also on FIG. 8. Furthermore, in at least one embodiment, when the changing mat 30 is attached to the bag body 12, the middle mat portion 36 preferably covers entirely the bottom wall 14 of the bag body 12 preferably embracing its lines and curves. It may or may not be attached to the bottom 14 with invisible magnet 15 snaps as shown in FIG. 7. This configuration has also the advantage or reinforcing the bottom wall 14 of the bag 10 when the changing mat 30 is attached on the outer surface of the bag body 12. In other words, the middle mat portion 36 matching the bottom wall 14 of the bag body 14 may act as a reinforcing element.

Figure 4:
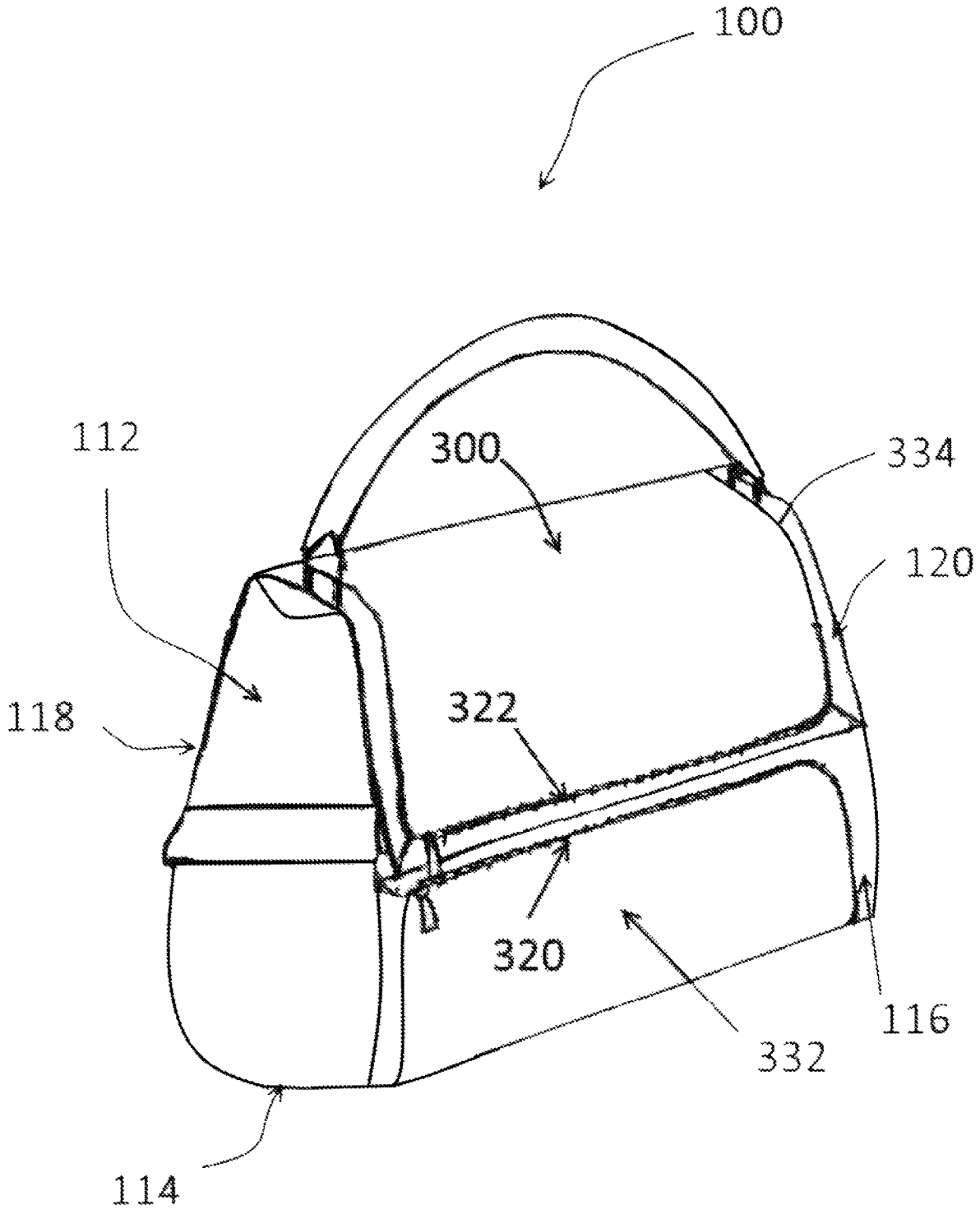
FIG. 4 illustrates a second embodiment of the bag with a changing pad almost entirely wrapping the bag body.
Figure 5:
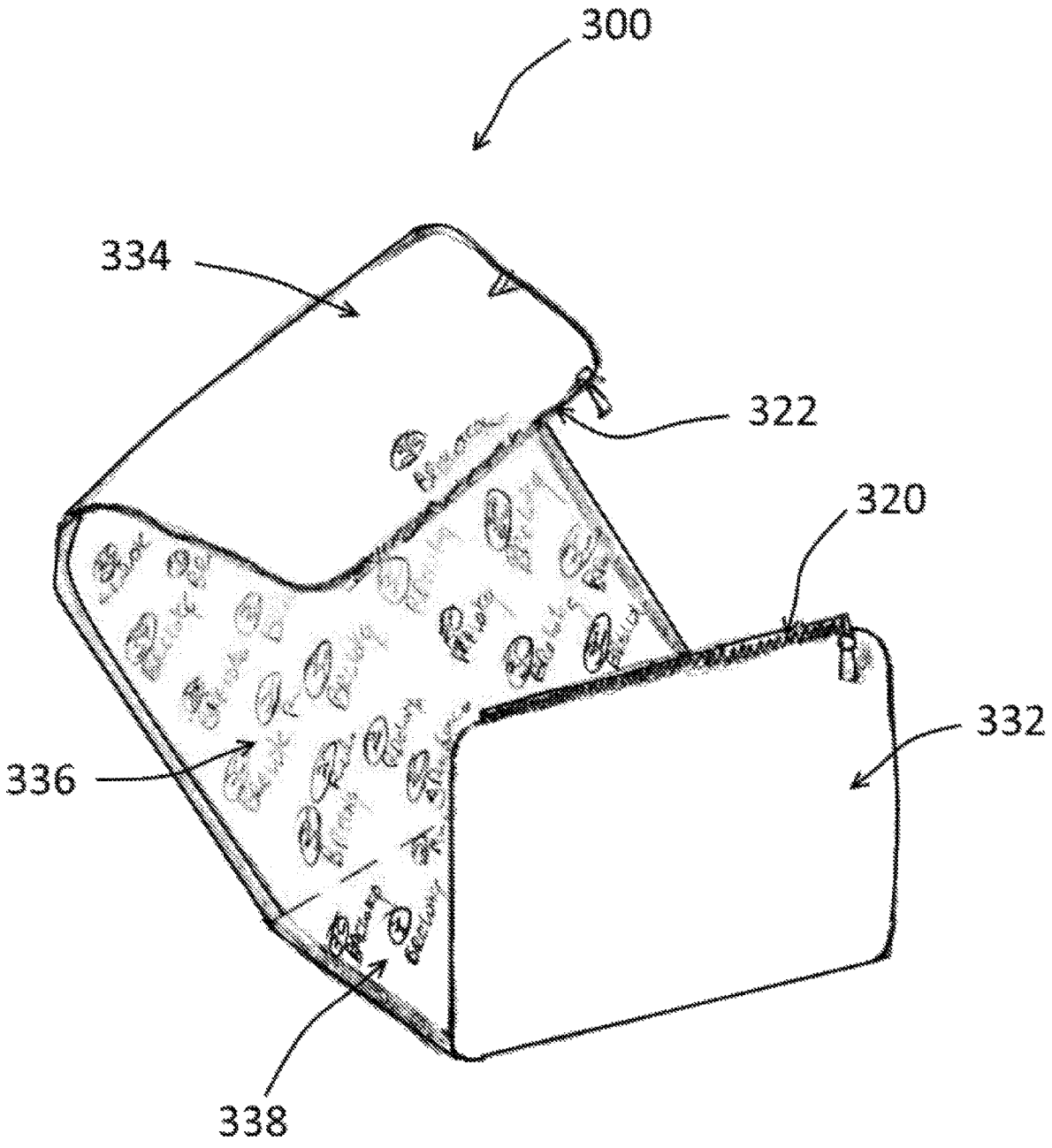
FIG. 5 shows the changing mat for the bag illustrates on FIG. 4.
Figure 6A:
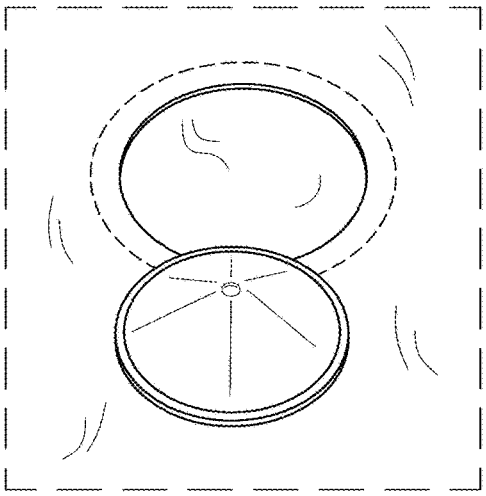
FIG. 6 shows different fasteners (A), (B), (C), (D) and (E) for the changing mat in accordance with various embodiments.
Figure 6C:
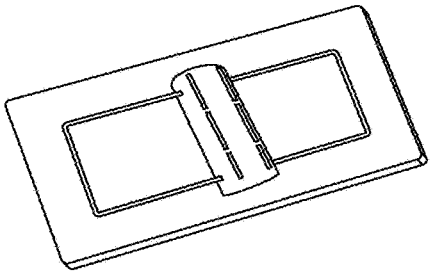
Figure 6B:
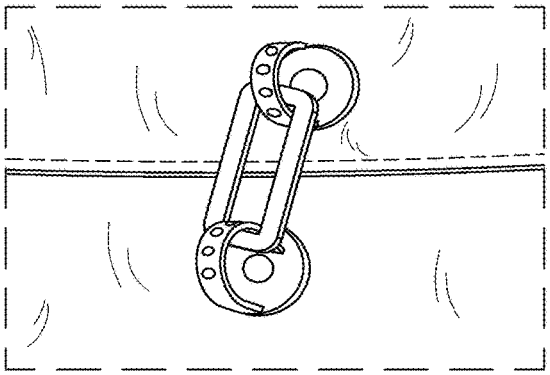
Figure 6D:
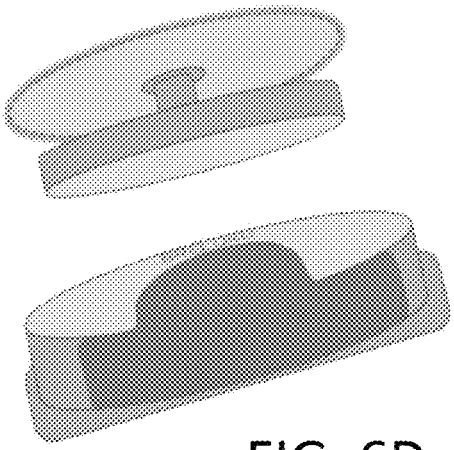
Figure 6E:
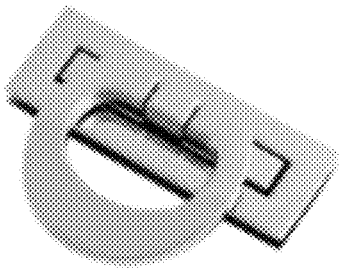

Referring now to FIGS. 4 and 5, a second example of a maternity bag 100 in accordance with the present invention is described.

The bag 100 has a flap 120 (the top front wall of the bag). The bag 100 comprises a changing mat or pad 300 also shown on FIG. 5. The changing mat 300 is adapted and dimensioned to almost entirely envelop or wrap the bag body 112. The changing mat 300 is attached to the front bottom wall 116 only, using fasteners 320, and to the top front wall 120 that is also the flap cover of the bag, using fastener 322. The fasteners are preferably zippers but the invention is not limited to this type of fasteners. In this exemplary embodiment, both first and second portions 332, 334 of the changing mat 300 are attached to either side of the bag body 116 or 120 using the fasteners 320, 322. The mid-section 336 of the mat 300 is maintained to the back of the bag's body 112 once the mat 300 is attached to the bag using the fasteners 320, 322. The mat follows the flap configuration and therefore can be opened even if the mat is affixed to the bag as shown in the figures.

The changing mats, such as those illustrated on FIG. 3 or 5, may include a reverse (35) that can be either plasticized and/or waterproof to ease the cleaning of the mat, but is not limited to the material used. The reverse may also include a padding element to increase the comfort for the baby.

The reverse is affixed, permanently or not, on the inner surface of the mat in order to be hidden when the mat is affixed to the bag body. A detachable reverse can be fixed to the mat using different kind of fasteners, such as but not limited to zippers, snap buttons, Velcro™, etc. Advantageously, a detachable reverse can easily be washed. The maternity bag with a washable changing mat becomes multifunctional.

Figure 9:
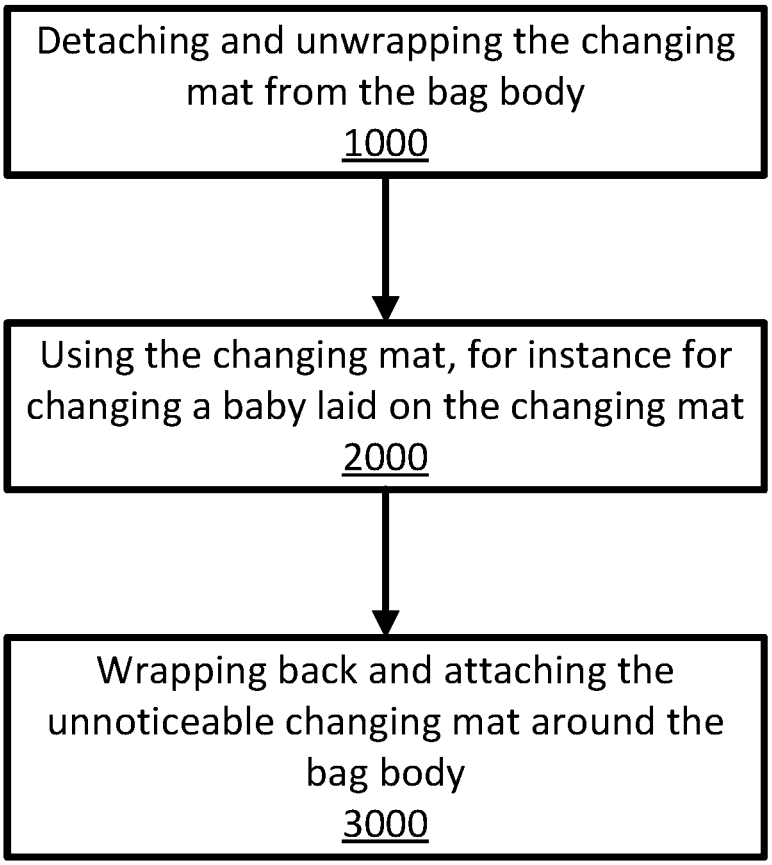
FIG. 9 is flowchart for illustrating the method for changing baby using the maternity bag according to a preferred embodiment.

As illustrated on FIG. 9, the method for changing babies using the maternity bag as defined in herein. The method comprises the steps of:

a. detaching and unwrapping the changing mat from the bag body 1000;
b. using the changing mat for changing a baby once the baby is laid on the changing mat 2000; and
c. once the baby has been changed, wrapping back and attaching the indistinguishable changing mat around the bag body 3000.

Figure 11:
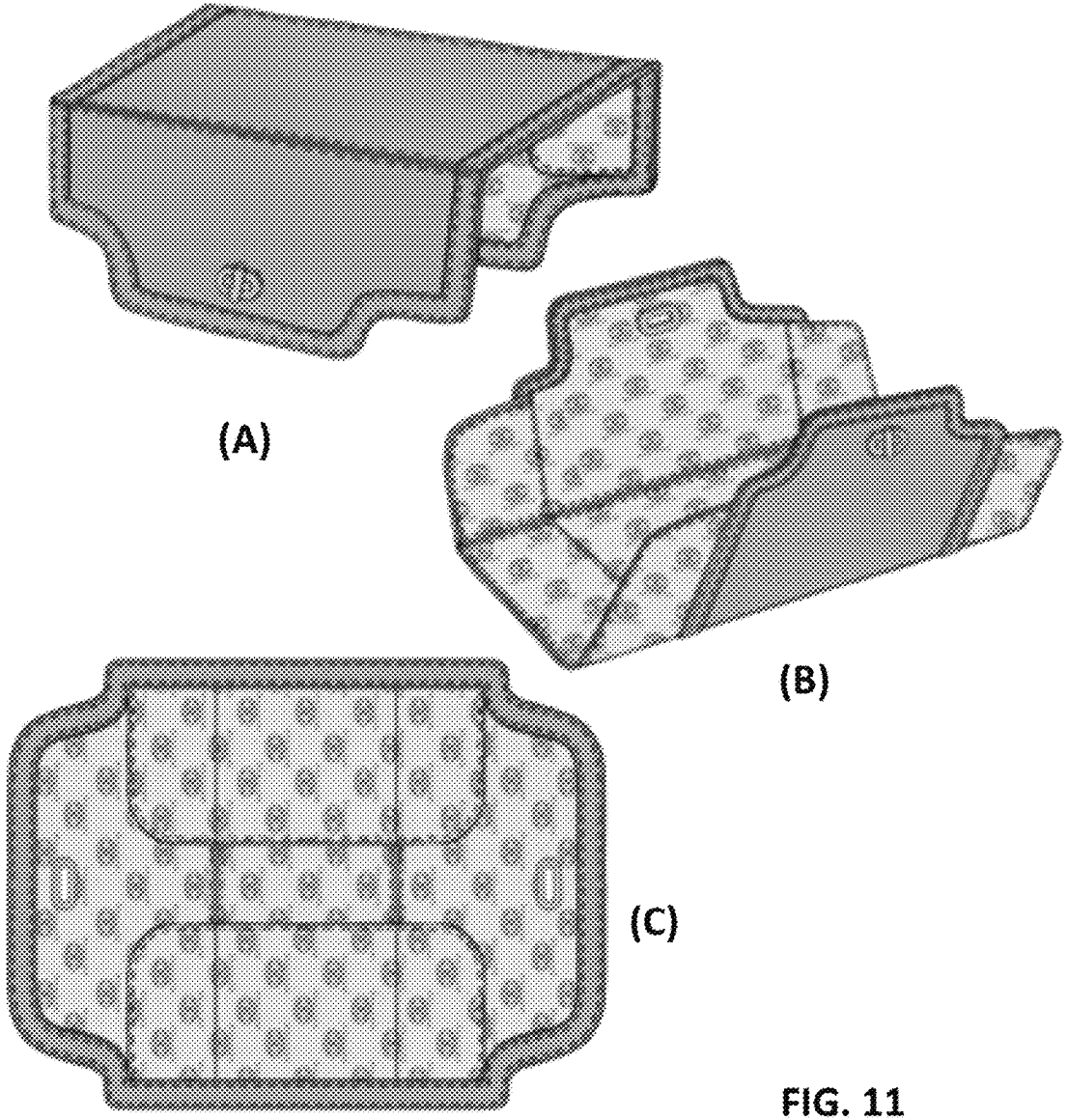
FIG. 11 is an illustration of the changing mat of the maternity bag illustrated on FIG. 10 according to three different positions (A), (B) or (C).
Figure 10:
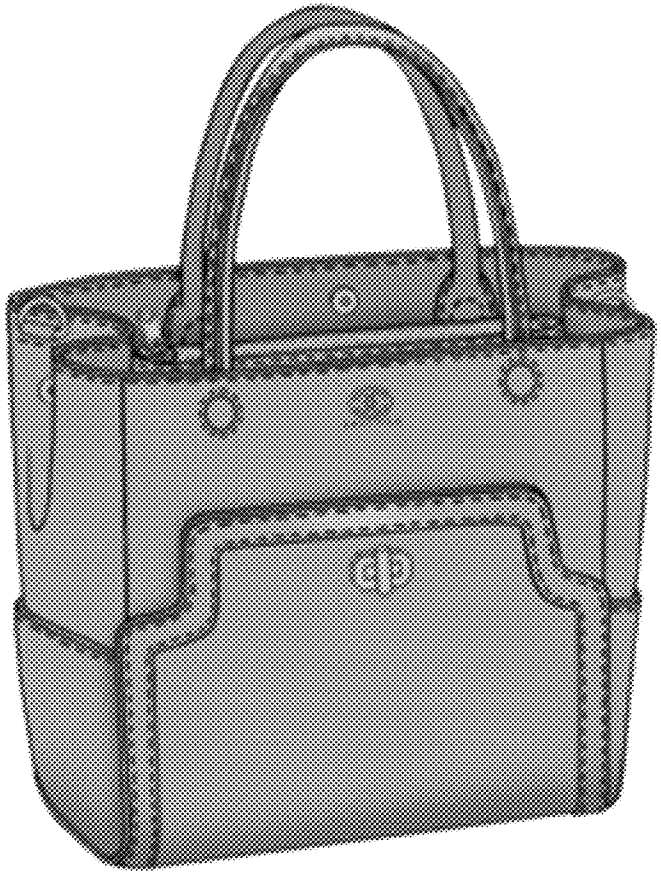
FIG. 10 is an illustration of the front view the maternity bag with the changing mat fully attached to a bag body, in accordance with another embodiment.

FIGS. 10 and 11 illustrate a maternity bag and a changing mat in accordance with another embodiment of the present invention. In particular, the wings of the mat further extend from the first and second mat portions in a foldable configuration to extend the extra width of the mat, as shown in FIG. 11(C).

In the two examples described here, the changing mat once wrapped and attached to the bag is indistinguishable. That way, the changing mat's look is concealed, subtle and/or unobtrusive, making both pieces come together as one with the appearance of a fashion bag. Also, the changing mat being wrapped around the bag, the changing mat reinforces the bag itself that can be loaded with all the items useful needed to care or for changing babies: wipes, diapers bottles, clothes, etc.

The present invention provides an elegant and stylishly fashionable look to the bag.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. A maternity bag comprising:

a bag body defining an outer surface of the bag body and having a bottom wall from which extend two side walls, a front wall and a rear wall, and also a top section defining an aperture giving access to inside the bag body; and a changing mat configured to be non-permanently attached to the outer surface of the bag body, the changing mat comprising a first mat portion and a second mat portion each hingely connected to a middle mat portion positioned there between, the middle mat portion matching in size the bottom wall of the bag body when the changing mat is attached to the bag body, the first mat portion and the second mat portion each comprising at least one attachment system to attach the first mat portion and the second mat portion to the front and rear walls of the outer surface of the bag body respectively;

wherein each of the front and rear walls comprises at least one fastener for non-permanently attaching the changing mat to the front and rear walls of the bag body in collaboration with the at least one fastener of the changing mat; and wherein the changing mat further comprises a pair of wings hingely connected to the middle mat portion, and also to the first and second mat portions, and extending from the middle mat portion in a perpendicular direction respectively to a direction of the first and second mat portions, the wings in an unfolded position providing an extra width to the changing mat when the changing mat is used for pampering the baby.

2. The maternity bag of claim 1, wherein the changing mat has the same texture and/or color as the outer surface of the bag body.

3. The maternity bag of claim 1, wherein the changing mat and the bag body are made of identical material.

4. The maternity bag of claim 3, wherein the changing mat has the same texture and/or color as the outer surface of the bag body.

5. The maternity bag of claim 1, wherein the changing mat and the bag body are made of different material for styling diversity.

6. The maternity bag of claim 1, wherein the changing mat has a different texture and/or color as the outer surface of the bag body.

7. The maternity bag of claim 1, wherein the changing mat comprises a protective lining.

8. The maternity bag of claim 7, wherein the protective lining is washable.

9. The maternity bag of claim 8, wherein the protective lining is detachable from the changing mat.

* * * * *